US006164021A

United States Patent [19]

Huber et al.

[11] Patent Number: 6,164,021

[45] Date of Patent: Dec. 26, 2000

[54] HIP AND RIDGE SEALING AND ATTACHMENT SYSTEM AND METHOD OF USING SAME

[75] Inventors: E. Richard Huber, Houston; Pat L. Murray, Spring, both of Tex.; David H. Faulkner, Lakeland; Robert L. Ferrante, Davie, both of Fla.

[73] Assignee: Polyfoam Products, Inc., Spring, Tex.

[21] Appl. No.: 09/245,052

[22] Filed: Feb. 4, 1999

Related U.S. Application Data

[60] Provisional application No. 60/074,347, Feb. 6, 1998.

[51] Int. Cl.[7] ..... E04D 1/36

[52] U.S. Cl. ..... 52/43; 52/57; 52/58; 52/309.5; 52/309.13; 52/741.4; 52/747.11

[58] Field of Search ..... 52/57, 58, 309.5, 52/309.9, 309.13, 90.1, 287.1, 460, 461, 469, 516, 519, 43, 741.4, 742.13, 747.11, 747.12, 748.1, DIG. 15

[56] References Cited

U.S. PATENT DOCUMENTS

| | | | |
|---|---|---|---|
| 2,152,080 | 3/1939 | Munsey | 52/747.11 X |
| 3,122,862 | 3/1964 | Figge . | |
| 3,148,104 | 9/1964 | Rapp . | |
| 3,200,026 | 8/1965 | Brown | 52/309.5 X |
| 3,411,256 | 11/1968 | Best . | |
| 3,646,715 | 3/1972 | Pope . | |
| 3,698,972 | 10/1972 | Lenzner . | |
| 3,760,546 | 9/1973 | Martin | 52/309.9 X |
| 4,036,673 | 7/1977 | Murphy et al. . | |
| 4,063,395 | 12/1977 | Stewart et al. | 52/309.5 X |
| 4,087,296 | 5/1978 | Hooker . | |
| 4,160,346 | 7/1979 | Kaufmann . | |
| 4,244,901 | 1/1981 | Wencley et al. . | |
| 4,315,391 | 2/1982 | Piazza . | |
| 4,489,176 | 12/1984 | Kluth et al. . | |
| 4,535,579 | 8/1985 | Burgoyne et al. . | |
| 4,636,425 | 1/1987 | Johnson et al. . | |
| 4,707,961 | 11/1987 | Nunley et al. . | |
| 4,888,932 | 12/1989 | Beare | 52/748.1 |
| 4,996,812 | 3/1991 | Venable . | |
| 5,032,623 | 7/1991 | Keske et al. . | |
| 5,219,097 | 6/1993 | Huber et al. . | |
| 5,253,461 | 10/1993 | Janoski et al. . | |
| 5,362,342 | 11/1994 | Murray et al. | 156/71 |
| 5,441,583 | 8/1995 | Eaton et al. . | |
| 5,895,536 | 4/1999 | Starr et al. | 156/71 |
| 5,947,817 | 9/1999 | Morris et al. | 52/199 X |
| 5,951,796 | 9/1999 | Murray | 156/78 |

FOREIGN PATENT DOCUMENTS

| | | | |
|---|---|---|---|
| 0 135 913 | 4/1985 | European Pat. Off. . | |
| 497725 | 8/1992 | European Pat. Off. | 52/309.5 |
| 2304165 | 12/1990 | Japan . | |
| 5112770 | 7/1993 | Japan . | |
| 158625 | 4/1957 | Sweden | 52/519 |
| 1 257 826 | 12/1971 | United Kingdom . | |

OTHER PUBLICATIONS

Sealoflex Inc., *Sealoflex™ Flexible Roof Waterproofing System*, Jan. 1997, 2 pp.

Everest Coatings Inc., *Evercoat 500/510 Elastomeric Acrylic Roof Coating*, Aug. 1996, 2 pp.

Everest Coatings Inc., *Evercoat 5400/5410 Ultra–High Strength Acrylic Elastomeric Roof Coating*, May 1997, 2 pp.

Carlisle Coatings & Waterproofing Inc., *Mult–I–Thane System 3000–60 Mil*, Oct. 1994, 2 pp.

*Primary Examiner*—Laura A. Callo

*Attorney, Agent, or Firm*—Akin, Gump, Strauss, Hauer & Feld, LLP

[57] ABSTRACT

A hip and ridge roof sealing and attachment system including a polyurethane foam adhesive first applied in a space between adjacent roof tiles along a hip or ridge of the roof. The first application of the polyurethane foam adhesive fills the space between the adjacent roof tiles. The polyurethane foam adhesive applied in a second application to adhere a lower surface of a hip or ridge tile to the first application of polyurethane foam adhesive and the adjacent roof tiles. The method of installing the hip and ridge roofing system includes the steps of applying a first layer of urethane foam adhesive in the space between adjacent roof tiles at a hip or ridge of a roof and adhering a hip or ridge tile to the first layer of urethane foam adhesive.

20 Claims, 2 Drawing Sheets

HIP AND RIDGE SEALING AND ATTACHMENT SYSTEM AND METHOD OF USING SAME

CROSS-REFERENCE TO RELATED APPLICATIONS

This application claims priority from provisional patent application Ser. No. 60/074,347, filed Feb. 6, 1998.

BACKGROUND OF THE INVENTION

1. Field of the Invention

The present invention relates to a sealing and attachment system and method of using same for a roof, and more specifically for a sealing and attachment system and method for hips and ridges of a roof.

2. Description of the Related Art

Roof tiles are widely used as roof coverings on pitched roof decks in various parts of this country as well as in other parts of the world. Roof tiles are extremely durable and provide significant aesthetic and decorative effects to the structures to which they are applied. Roof tiles as described herein may be made of cementitious materials and also ceramic, brick, stone, clay, plastic, wood, metal, rubber or bituminous materials.

Pitched roofs come in a few basic styles that are particularly relevant to the present invention. A duo-pitched roof has two sloping sides joined along the top with end vertical walls called a gable end. This is probably the most common form of pitched roof. When the end of the roof is also sloping it is termed hipped. When two sections of roof meet at an angle, such as a right angle, the junction between the two roof sections is termed a valley.

A typical pitched tile roofing system includes sheets of plywood nailed to the truss rafters to form a roof deck. The pitched roof deck is overlaid with a roof substrate made of a waterproofing material. Typically, the waterproofing material forming the roof substrate is asphalt, tar, or one or more plies of felt attached to the pitched roof deck. The felt is typically attached to the pitched roof deck by nails and/or adhesive. Felt is generally made of wood pulp and rag or of asbestos, polyester or glass fibers.

Installation of the roof tiles begins along the lower edge of the pitched roof deck and continues until reaching the apex of the roof. At the apex of the roof and along the hip, the roof tiles adjacent the apex or hip on each roof plane are covered by a row of half-round or angled ridge or hip tiles.

The areas between adjoining hip and ridge roof planes are typically the most troublesome areas from a performance standpoint. These areas must be sealed to prevent the infiltration of wind-driven rain, hail or snow. In most applications, a watertight seal joining the two courses of tiles between the roof planes has to be formed. Some common techniques to seal adjoining hip and ridge planes are by the use of mortar, self-adhered roll products or preformed plastic or metal strips. The plastic or metal strips do not completely seal the hip and ridge area. The self-adhered roll products may perform somewhat better than the plastic or metal strips; however, the roll products require additional mechanical attachment to secure the hip and ridge accessories to the structure. The mechanical attachment typically comprises nails or screws in the roof deck forming yet additional possible leak paths. Filling the area in with mortar will temporarily seal the hip and ridge areas and may only provide attachment to certain roofing components. The mortar method of attachment is usually temporary and eventually fails after cyclical changes of the weather. Of even greater significance, the mortar will not perform well in areas subject to freeze and thaw conditions.

It is desirable to have a reliable and long-lasting sealing and attachment system for hip and ridge tiles. Furthermore, it is desirable that the method of installation be a simple operation, non-labor intensive, economical and provide a quick bond between the hip or ridge tile and the roof component. Furthermore, the bond should withstand the long-term effects of temperature variations experienced by the roof under normal circumstances.

SUMMARY OF THE INVENTION

The present invention is a hip and ridge sealing and attachment system and method of using same. The sealing and attachment system is a reliable and long-lasting weather blocking and attachment system for hip and ridge tiles. The present invention involves a method of installation that is a simple operation, non-labor intensive, economical and provides a quick bond between the hip or ridge tile and the roof component using polyurethane foam adhesive. Furthermore, the sealing and attachment system withstands the long-term effects of temperature variations experienced by the roof under normal circumstances.

The hip and ridge roof sealing and attachment system includes a polyurethane foam adhesive first applied in a space between adjacent roof tiles along a hip or ridge of the roof. The first application of the polyurethane foam adhesive fills the space between the adjacent roof tiles. The polyurethane foam adhesive applied in a second application to adhere a lower surface of a hip or ridge tile to the first application of polyurethane foam adhesive and the adjacent roof tiles.

The method of installing the hip and ridge roofing system includes the steps of applying a first layer of urethane foam adhesive in the space between adjacent roof tiles at a hip or ridge of a roof and adhering a hip or ridge tile to the first layer of urethane foam adhesive.

The hip and ridge sealing and attachment system provides a cost-effective method to be used as both the weatherproofing and the attachment adhesive for securing the hip and ridge roofing components to the structure. The system provides superior resistance to wind uplift and additional support for traversing the tile. The system allows for a single source of responsibility and provides a superior system to those presently available.

BRIEF DESCRIPTION OF THE DRAWINGS

The objects, advantages, and features of the invention will become more apparent by reference to the drawings which are appended hereto and wherein like numerals indicate like parts and wherein an illustrated embodiment of the invention is shown, in which.

DETAILED DESCRIPTION OF INVENTION

Figure 1:
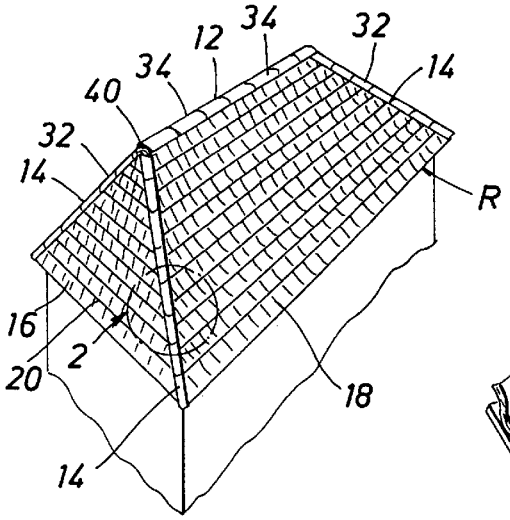
FIG. 1 is a perspective view of a typical tile roof having a ridge and hips.

The hip and ridge sealing and attachment system, generally referred to as 10, will now be described with reference to the drawings. Referring to FIG. 1, a tile roof R is shown having a ridge 12 at the apex of the roof R and hips 14 spanning between the apex and the lower edge of the roof R. The roof R is shown roofed with a plurality of roof tiles 16. The roof tiles 16 shown in the figures are generally known as semi-circular tiles. It is to be understood that the hip and ridge sealing and attachment system 10 of the present invention can be used with roof tiles 16 of other profiles and configurations. For example, the present invention can also be used with flat roof tiles and reverse curve roof tiles. Typically, the roof tiles 16 are made from ceramic or clay materials. It is also to be understood that the hip and ridge sealing and attachment system 10 of the present invention is not limited to clay or ceramic roof tiles 16, but is also applicable to roof tiles 16 made from other materials such as brick, stone, cement, plastic, wood, metal, etc.

Figure 2:
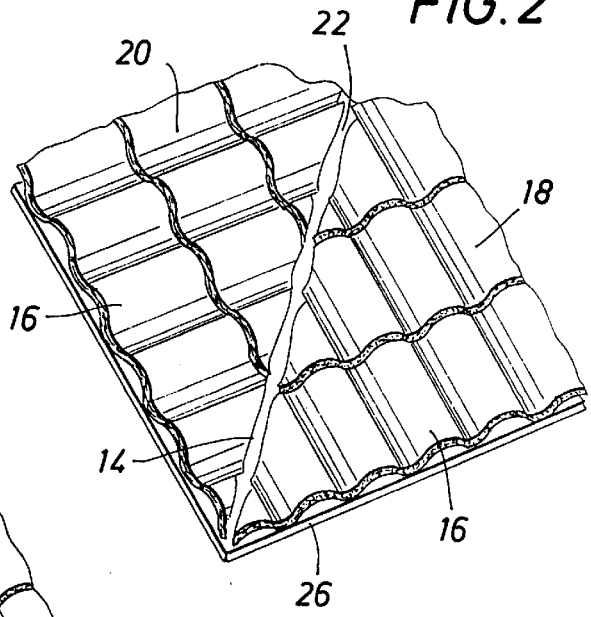
FIG. 2 is an enlarged, perspective view of a portion of the hip roof shown in FIG. 1 with the hip tiles removed and showing the gap between tiles of the adjoining hip roof planes.
Figure 7:
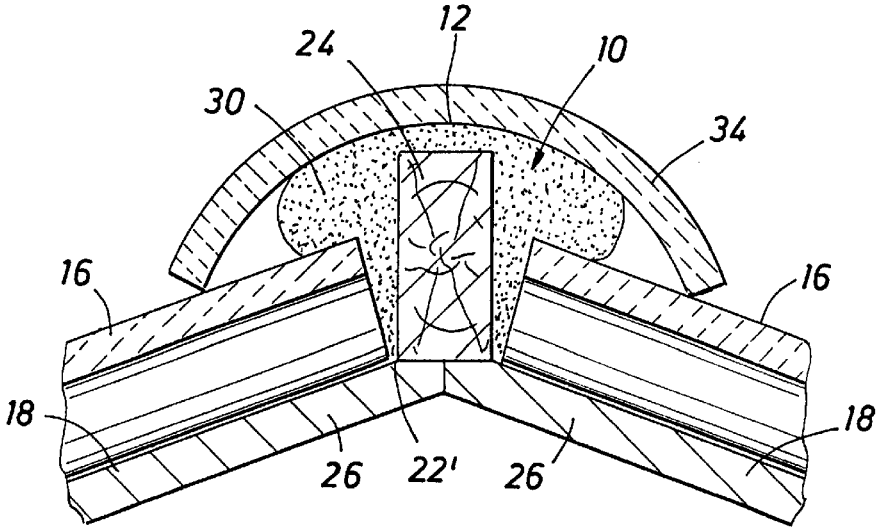
FIG. 7 is a cross-sectional view of the ridge showing a ridge board in the gap between the tiles of the adjoining roof planes.

Referring to FIGS. 1 and 2, the hip 14 is formed at the juncture of a roof plane 18 with a roof plane 20. A space or gap 22 is formed between the adjacent tiles 16 of roof planes 20 and 18, respectively, as shown in FIG. 2. In some instances a hip board (not shown), similar to a ridge board 24 shown in FIG. 7, is installed in the hip space 22 between the tiles 16. When used, the hip board is secured to the roof deck 26 in an acceptable way commonly used in the industry. The space 22 between the tiles 16 at the hip 14 (FIG. 2) must be sealed to prevent the infiltration of wind driven rain, hail or snow.

Similarly, referring to FIG. 1, the ridge 12 is formed at the apex of two roof planes 18. A space or gap 22' is formed between the adjacent upper rows of tiles 16 of the roof planes 18, as shown in FIG. 7. In some instances a ridge board 24 (FIG. 7) is installed in the ridge space 22' between the upper rows of tiles 16. When used, the ridge board 24 is secured to the roof deck 26 in an acceptable way commonly used in the industry. The ridge space 22' between the upper rows of tiles 16 at the ridge 12 must be sealed to prevent the infiltration of wind driven rain, hail or snow.

The sealing and attachment system 10 of the present invention provides the seal between the adjacent roof tiles 16 if no hip board or ridge board 24 is used. The sealing and attachment system 10 also provides the seal between the roof tile 16 and the hip board or ridge board 24 when using the hip board or ridge board. The sealing and attachment system 10 comprises a polyurethane foam adhesive 30.

Figure 4:
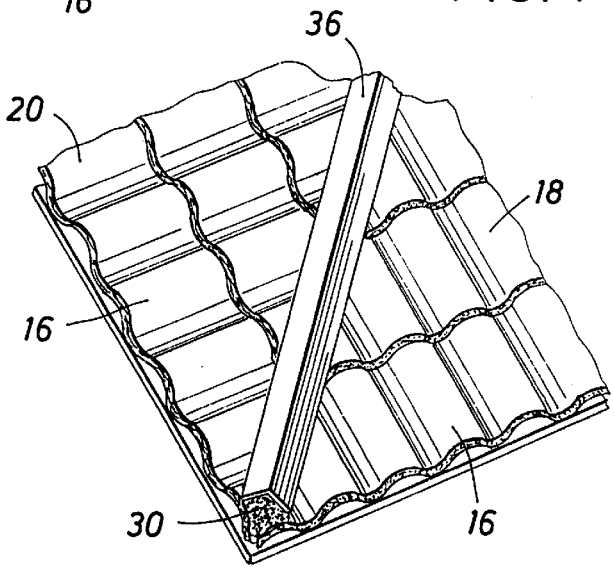
FIG. 4 is a view similar to FIGS. 2 and 3 showing a drip edge installed along the hip.

As will be further explained below, the polyurethane foam adhesive 30 of the present invention seals the hip and ridge gaps 22 and 22', respectively, and also provides the attachment mechanism for the hip tiles 32 (FIGS. 5 and 6) and ridge tiles 34 (FIG. 7). In addition to providing the attachment mechanism for the hip and ridge tiles 32 and 34, respectively, to the roof R, the polyurethane foam adhesive 30 also provides the attachment mechanism for other roofing accessories, such as a drip edge 36 (FIG. 4). The polyurethane foam adhesive 30 will bond to various roofing components such as hip and ridge boards 24, tiles 16, and roofing substrates including wood, metal, concrete, and roofing felt.

Figure 3:
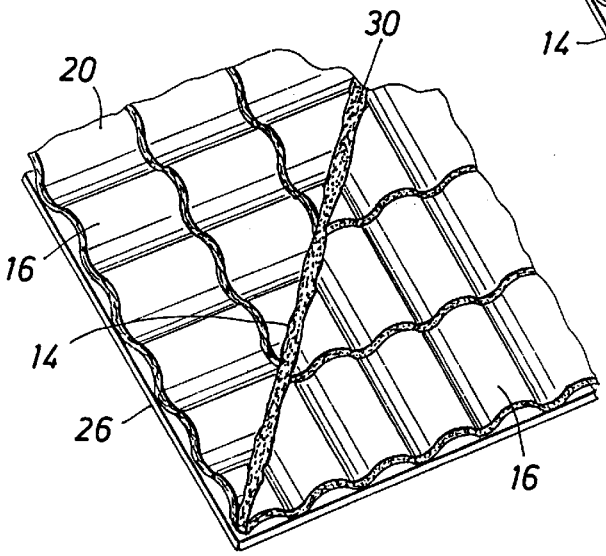
FIG. 3 is a view similar to FIG. 2 showing the gap filled with polyurethane foam to provide waterproofing along the junction of the tiles of the adjoining hip roof planes.

The method of using and applying the weatherproofing and attachment system 10 will now be described in detail. FIG. 2 shows a portion of the hip roof 14 and the hip space or gap 22 between roof tiles 16 of the adjoining hip roof planes 18 and 20. Referring to FIG. 3, the sealing or weatherproofing application between the roof tiles 16 along the hip 14 is performed, either by applying a continuous bead or by the application of multiple dispensed quantities of polyurethane foam adhesive 30 in the hip space 22. The amount of polyurethane foam adhesive 30 needed to seal the hip space is dependent on the space 22 between the adjoining roof tiles 16 (FIG. 6) or the space between the roof tile 16 and the hip board (not shown).

A similar method is employed to seal the ridge gap 22'. Referring to FIG. 7, the sealing or weatherproofing application between the roof tiles 16 along the ridge 12 is performed, either by a continuous bead or by the application of multiple dispensed quantities of polyurethane foam adhesive 30 in the ridge space 22'. The amount of polyurethane foam adhesive 30 needed to seal the ridge junction is dependent on the space 22' between the adjoining roof tiles 16 or the space between the roof tile 16 and the ridge board 24 as shown in FIG. 7.

Figure 5:
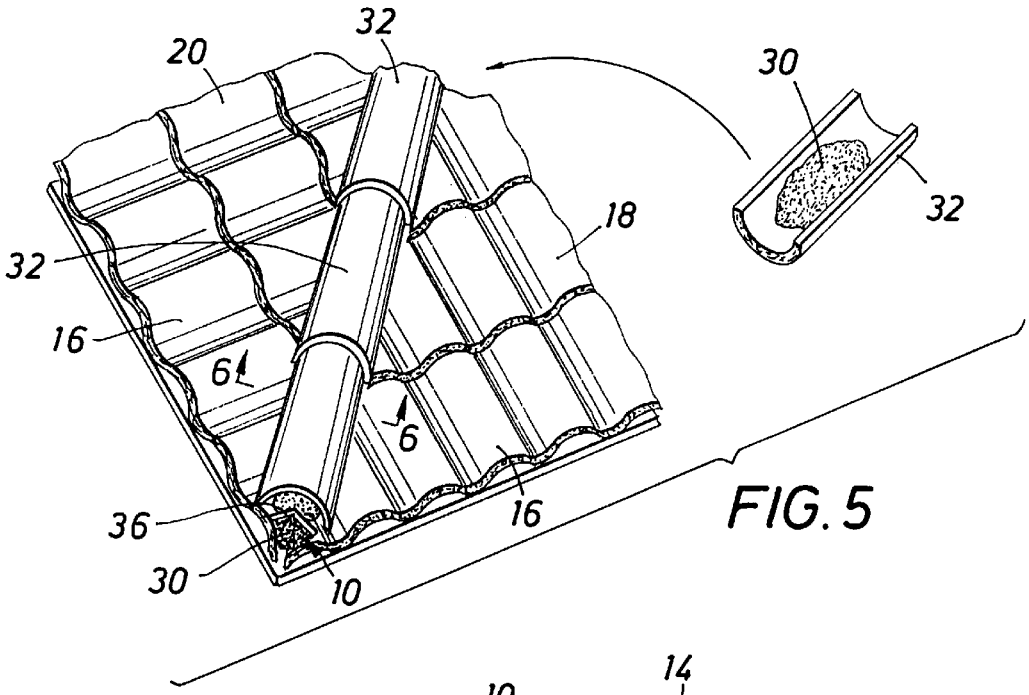
FIG. 5 is a view similar to FIGS. 2–4 showing the installation of hip tiles with the polyurethane foam.
Figure 6:
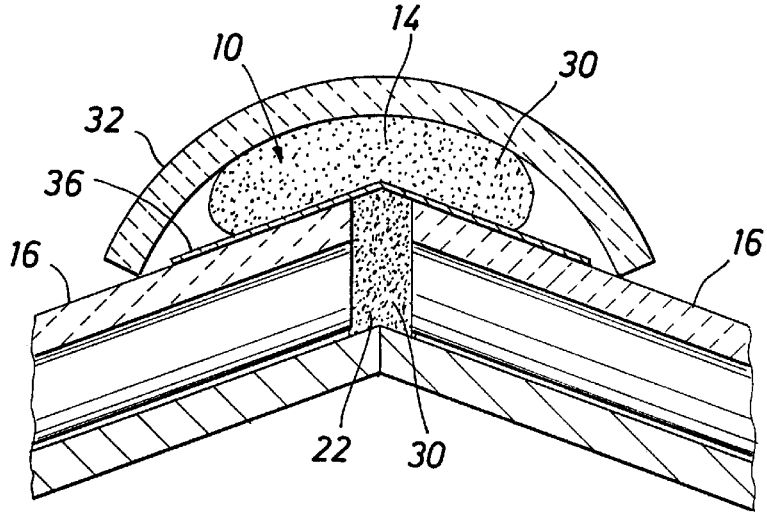
FIG. 6 is a view taken along line 6—6 of FIG. 5.

If no ridge board 24 or hip board is used as shown in FIGS. 2 and 3, preferably a polyurethane foam adhesive bead having a width of approximately two inches, if necessary, is applied down the center of the hip or ridge junction filling all of the space 22 or 22' with the polyurethane foam adhesive 30. In the preferred embodiment of the present invention, the polyurethane foam adhesive 30 will expand approximately two to three times its original dispensed size filling any voids at the hip or ridge junction. If needed, additional polyurethane foam adhesive 30 should be applied to ensure that all voids are filled. After filling the space 22, 22' with the polyurethane foam adhesive 30, an optional drip edge 36, typically of metal, can be placed onto the polyurethane foam adhesive 30 prior to the polyurethane foam adhesive 30 skinning over. The drip edge 36 is shaped like an inverted "V" and is placed along the center of the hip or ridge junction as shown in FIGS. 4–6.

If a hip or ridge board 24 is used as shown in FIG. 7, preferably a polyurethane foam adhesive bead having a width of approximately two inches, if necessary, is applied approximately one to two inches above the roof tiles 16 on both sides of the hip or ridge board 24. The polyurethane foam adhesive 30 will begin to flow down toward the surface of the roof tiles 16. The polyurethane foam adhesive 30 will begin expanding approximately two to three times it original dispensed size filling any voids at the hip or ridge junction. Additional foam adhesive 30 is applied, if needed, to fill any remaining voids.

The attachment application follows the weatherproofing application described above. The attachment application can also be made with a continuous bead or individual quantities or paddies. Preferably, a bead or paddy of polyurethane foam adhesive 30 is applied along the center of the underside of the ridge tile 34 or hip tile 32 as shown in FIG. 5. The hip or ridge tile 32 or 34, respectively, is turned back over and installed over either the drip edge 36 (FIGS. 5 and 6), the hip or ridge board 24 (FIG. 7), or the weatherproofing polyurethane foam adhesive layer in the space 22, 22'.

Preferably, the hip tiles 32 are installed beginning at the lower end of the hip 14 and ending at the upper end of the hip 14 as is common in the industry. The hip and ridge tiles 32 and 34, respectively, are preferably centered along the hip and ridge junction.

After the hip and ridge tiles 32 and 34, respectively, have been installed, a small paddy of polyurethane foam adhesive 30 is applied to the center of the hip and ridge junction 40 (FIG. 1). Once the paddy has skinned over and is firm to the touch, typically within three to five minutes, another paddy of polyurethane foam adhesive 30 is applied on top the previous paddy. This process is continued until enough foam adhesive 30 is applied to make contact with the underside of the ridge tile 34 ensuring approximately fifteen to twenty square inches of contact area. Preferably, the foam adhesive 30 that is exposed to direct sunlight or UV rays should be coated with one to three coats of high quality acrylic paint. Indirect exposure of the foam adhesive to UV rays is acceptable.

It is to be understood that the polyurethane foam adhesive 30 may be a single or plural component polyurethane foam. Preferably, the polyurethane foam adhesive 30 is a plural component foam. The chemical reactants for the polyurethane foam adhesive 30 are a polyisocyanate designated as component A and a liquid organic resin designated as component B. While the polyurethane foam adhesive 30 of the present invention can be a single component polyurethane foam, a plural component polyurethane foam adhesive provides significant advantages over a single component polyurethane foam in this type of application. A single component polyurethane foam takes several hours to cure internally whereas a plural component polyurethane foam can have a very short reactivity time and be cured within minutes. Thus, the significant advantage of the plural component polyurethane foam adhesive is being able to walk on the installed roof tiles shortly after their installation without affecting the bond of the roof tile. The reactivity period or rise time of the plural component polyurethane foam adhesive 30 of the preferred embodiment of the present invention is preferably about one-half to about ten minutes and most preferably about one and one-half to about four minutes. It is important that the roof tile be properly placed during the reactivity period to achieve the required bonding of the roof tile to the roof component to which it is being attached. During the reactivity period, the polyurethane foam adhesive 30 is an expanding foam which will fill gaps and imperfections. The resulting foam 30 provides excellent bonding between the roof tile and the roof component due to the adhesive properties of the urethane. It has been found that a reactivity period of less than about one-half minute makes it difficult to timely place the roof tile during the reactivity period.

The polyurethane foam adhesive 30 is preferably a froth foam. Froth foam chemistry is well known in the art of urethane foams. The froth foam may be formed by using blowing agents such as hydrogenated chlorofluorocarbon R22 (HCFC-R22), hydrogenated fluorocarbon 134A (HFC-134A), or chlorofluorocarbon R12 (CFC-R12). Preferably, the froth foam adhesive 30 is formed by using the hydrogenated blowing agents HCFC-R22 or HFC-134A and not CFC-R12 due to CFC-R12's reported deleterious effects to the earth's ozone layer.

Preferably, the froth foam adhesive 30 has a consistency similar to a foamy shaving cream. The froth foam is preferable over other types of foams because it can be neatly and accurately dispensed from a foam dispensing gun without blowing or overspraying onto other areas of the roof or onto the outer surface of adjacently installed roof tiles. The preferred polyurethane foam adhesive 30 with its shaving cream consistency does not run when placed onto a steeply pitched roof, but substantially remains where it is installed on the roof. This ensures that the adhesive bond will be formed properly.

The polyurethane foam adhesive 30 preferably has a density of about one to about eight pounds per cubic foot. It may be desirable to minimize the density of the polyurethane foam adhesive 30 to reduce the weight on the roof while still providing an excellent bonding of the roof tile to the roof component. It has been found to be most preferable to have a foam density of about one and one-half to about two pounds per cubic foot.

The application rate of the polyurethane foam adhesive 30 is preferably about one to about six pounds per minute and most preferably about two to about three pounds per minute.

The mixing and dispensing of the plural component foam can be accomplished with a foam dispensing system as described in Assignee's U.S. Pat. Nos. 5,163,584 and 5,219,097. Applicant hereby incorporates U.S. Pat. Nos. 5,163,584 and 5,219,097 by reference herein. The preferred foam-dispensing gun and foam dispensing system are available from Polyfoam Products, Inc. of Spring, Tex.

As best shown in FIGS. 6 and 7, the polyurethane foam adhesive 30 expands and fills gaps between the roof tiles 16, 32 and 34, roof deck 26 and drip edge 36 to form a weatherproof layer. Additionally, the polyurethane foam adhesive 30 provides the attachment mechanism for securely attaching the various roofing components without puncturing the roof deck 26.

The system of the present invention may be used in conjunction with the method of bonding roof tiles described in Assignee's U.S. Pat. No. 5,362,342 which is hereby incorporated by reference.

The method of bonding roof tiles to the roof substrate described above is a highly efficient and economical method which does not add needless weight to the roof. The method is non-labor intensive and results in a very high bond between the roof tile and the roof substrate. The foam provides a very quick bond which can be walked on within approximately twenty minutes. Additionally, it has been found that the roof tile can be moved during the first one to three minutes while the foam is still soft without affecting the bond. The foam can be quickly and cleanly applied with equipment which is extremely dependable and easy to operate which results in a highly cost effective and safe roof tile installation procedure.

The hip and ridge sealing and attachment system 10 provides a cost-effective method to be used as both the weatherproofing and as the attachment adhesive for securing the hip and ridge roofing components to the structure. The system 10 provides superior resistance to wind uplift and additional support for traversing the tile. The system 10 is ideal for patching and repair and enables the installer to replace tiles when traditional fastening cannot be achieved. The system 10 allows for a single source of responsibility and provides a superior system to those presently available.

It should be understood that the present invention consists of a method of bonding roof tiles utilizing urethane foam and the invention should not be unduly limited to the foregoing set forth for illustrative purposes. Various modifications and alterations of the invention will be apparent to those skilled in the art without departing from the true scope of the invention.

What is claimed is:

1. A hip and ridge roofing system in a roof comprised of a pitched roof having at least two roof deck planes with a plurality of roof tiles secured to each roof deck and having a space between adjacent roof tiles at a hip or ridge of the roof, the hip and ridge roofing system comprising:

a first layer of urethane foam adhesive applied in the space between the adjacent roof tiles; and a second layer of urethane foam adhesive adhering a hip or ridge tile to said first layer.

2. The roofing system of claim 1, wherein said hip or ridge tile is adhered with said second layer of urethane foam adhesive to the adjacent roof tiles.

3. The roofing system of claim 1, wherein said first layer fills all voids in the space between the adjacent roof tiles.

4. The roofing system of claim 1, wherein said first and second layers of urethane foam adhesive is a polyurethane foam.

5. The roofing system of claim 1, further comprising a hip or ridge board positioned in the space between the adjacent roof tiles and said first layer of urethane foam adhesive fills the space between the adjacent roof tiles and said hip or ridge board.

6. The roofing system of claim 1, further comprising a drip edge adhered to said first layer of urethane foam adhesive.

7. A hip and ridge roof sealing and attachment system in a roof comprised of a pitched roof having at least two roof deck planes with a plurality of roof tiles secured to each roof deck and having a space between adjacent roof tiles at a hip or ridge of the roof, the hip and ridge roof sealing and attachment system comprising:

a polyurethane foam adhesive applied in a first application in a space between adjacent roof tiles along a hip or ridge, said first application filling the space between the adjacent roof tiles; and said polyurethane foam adhesive applied in a second application to adhere a lower surface of a hip or ridge tile to said first application of polyurethane foam adhesive and the adjacent roof tiles.

8. A method of installing a hip and ridge roofing system comprising the steps of:

applying a first layer of urethane foam adhesive in a space between a adjacent roof tiles at a hip or ridge of a roof, and allowing the first layer of urethane foam adhesive to at least partially cure prior to adhering a hip or ridge tile to the first layer of urethane foam adhesive.

9. The method of claim 8, wherein the hip or ridge tile is adhered to the first layer with urethane foam adhesive.

10. The method of claim 8, wherein the first layer of urethane foam adhesive fills the entire space between the adjacent roof tiles.

11. The method of claim 8, wherein the urethane foam adhesive is a polyurethane foam.

12. A hip and ridge roofing system in a roof having a space between adjacent roof tiles at a hip or ridge of the roof, the hip and ridge roofing system comprising:

a hip or ridge board positioned in the space between the adjacent roof tiles;

a first layer of urethane foam adhesive applied in the space between the adjacent roof tiles and said hip or ridge board; and a second layer of urethane foam adhesive adhering a hip or ridge tile to said hip or ridge board.

13. The roofing system of claim 12, where in said first layer of urethane foam adhesive fills the space between the adjacent roof tiles and said hip or ridge board.

14. The roofing system of claim 12, wherein said first layer of urethane foam adhesive forms a weatherproofing layer.

15. The roofing system of claim 12, wherein said first layer of urethane foam adhesive forms a seal with the adjacent roof tiles in the space therebetween.

16. The roofing system of claim 12, wherein said second layer of urethane foam adhesive adheres said hip or ridge tile to said first layer.

17. A hip and ridge roofing system in a roof having a space between adjacent roof tiles at a hip or ridge of the roof, the hip and ridge roofing system comprising:

a first layer of urethane foam adhesive applied in the space between the adjacent roof tiles;

a drip edge adhered to said first layer of urethane foam adhesive; and a second layer of urethane foam adhesive adhering a hip or ridge tile to said drip edge.

18. The roofing system of claim 17, wherein said first layer of urethane foam adhesive fills the space between the adjacent roof tiles.

19. The roofing system of claim 17, wherein said first layer of urethane foam adhesive forms a weatherproofing layer.

20. The roofing system of claim 17, wherein said first layer of urethane foam adhesive forms a seal with the adjacent roof tiles in the space therebetween.

* * * * *